United States Patent [19]

Keller et al.

[11] 4,249,508

[45] Feb. 10, 1981

[54] SPRING ASSEMBLY FOR BALL THROWING MACHINES

[75] Inventors: Harold A. Keller; Clinton G. Glover, both of Clarkston, Wash.

[73] Assignee: Cytron, Inc., Lewiston, Id.

[21] Appl. No.: 49,478

[22] Filed: Jun. 18, 1979

[51] Int. Cl.[3] ..... F41D 11/00

[52] U.S. Cl. ..... 124/80; 124/7

[58] Field of Search ..... 124/7, 36, 41 R, 80, 124/26, 27, 28, 29; 273/129 R, 26 D; 267/136, 58, 57, 60, 162, 158 R, 164, 8 R

[56] References Cited

U.S. PATENT DOCUMENTS

| | | | |
|---|---|---|---|
| 629,044 | 7/1899 | McGlashan | 124/7 |
| 1,758,032 | 5/1930 | Dickman | 124/26 |
| 1,777,976 | 10/1930 | LaCoste | 273/26 D X |
| 2,660,158 | 11/1953 | Binks | 124/7 |
| 3,838,677 | 10/1974 | Alvares | 124/36 X |
| 3,841,294 | 10/1974 | McGill | 124/36 X |

FOREIGN PATENT DOCUMENTS

| | | | |
|---|---|---|---|
| 899184 | 5/1972 | Canada | 124/7 |

*Primary Examiner*—William R. Browne

*Attorney, Agent, or Firm*—Wells, St. John & Roberts

[57] ABSTRACT

An improved spring assembly for driving the throwing arm of a ball throwing machine. The assembly is mountable on a central transverse drive shaft of the machine. It includes a primary spring with an outwardly extending loop for loading against an abutment as the shaft is rotated in a first direction about its axis and for unloading in the first direction upon disengagement of the abutment. A secondary spring assembly is mountable to the drive shaft and includes a looped end engaging the outwardly extending arm of the primary spring assembly at a point approximately midway along its length. The secondary spring loads against the loop of the primary spring in response to rotation of the drive shaft, and unloads to drive the first loop forcibly in the first direction upon disengagement of the abutment by the first loop. An energy absorbing spring of the assembly mounts to the drive shaft and operatively engages the first loop to prevent stress reversal in the primary and secondary spring assemblies due to unrestricted unloading. All three springs are mounted to at least one central hub that in turn is mountable to the drive shaft for rotation therewith.

14 Claims, 7 Drawing Figures

SPRING ASSEMBLY FOR BALL THROWING MACHINES

BACKGROUND OF THE INVENTION

The present invention is concerned with spring assemblies utilized to drive the throwing arm of a ball throwing machine that is loaded against a stationary abutment in response to rotation of a central drive shaft.

Various machines have been designed for use in mechanically throwing balls for batting practice and catching in various sports. Such a machine is illustrated and described in our prior application titled "Ball Throwing Machine" filed Mar. 10, 1978, Ser. No. 885,443. Described is a compact lightweight machine for throwing balls along a desired trajectory. It includes a housing with an arcuate track leading inwardly from an opening to an initial ball support station. An abutment is selectively positioned at one of several locations adjacent to the ball support station. A throwing arm is rotatably mounted within the housing and is connected to a spring on the drive shaft. The spring will load in response to rotation of the drive shaft, pressing the throwing arm against the abutment. When the spring is sufficiently loaded, the throwing arm will slip from engagement with the abutment and forcibly move against the ball to eject it from the opening of the housing at relatively high velocity. An energy absorbing provision is made to take up at least some of the momentum of the spring as it moves past the release point between the ball and the throwing arm. The energy absorbing feature is provided in the form of an oppositely wound spring that is positioned on the drive shaft to load against the throwing arm as it moves a normal, unloaded position, thereby preventing stress reversal within the spring that drives the throwing arm.

The spring arrangement for the pitching machine disclosed above is very effective and durable, especially with the added provision of the energy absorbing spring mechanism. However, repeated stresses occur along the length of the throwing arm and with extended use, the throwing arm will fail.

The throwing arm, when under load, takes on the stress characteristics of a cantilevered beam with an anchor point at the abutment and a load produced at the inner end of the arm where it connects to the driving torsion spring. As with all cantilevered beams loaded at one end, strain increases progressively along the length of the arm from a zero point at the load to a maximum load at the anchor point. Therefore, the throwing arm is under twice the strain at the anchor point as it is midway along its length. This concentrated and repeated stress along the length of the throwing arm causes eventual fatigue of the throwing arm spring material, which leads to eventual material failure.

It therefore becomes desirable to increase the effective life of the spring assembly by more evenly distributing loads along the length of the throwing arm.

DETAILED DESCRIPTION OF A PREFERRED EMBODIMENT

Figure 1:
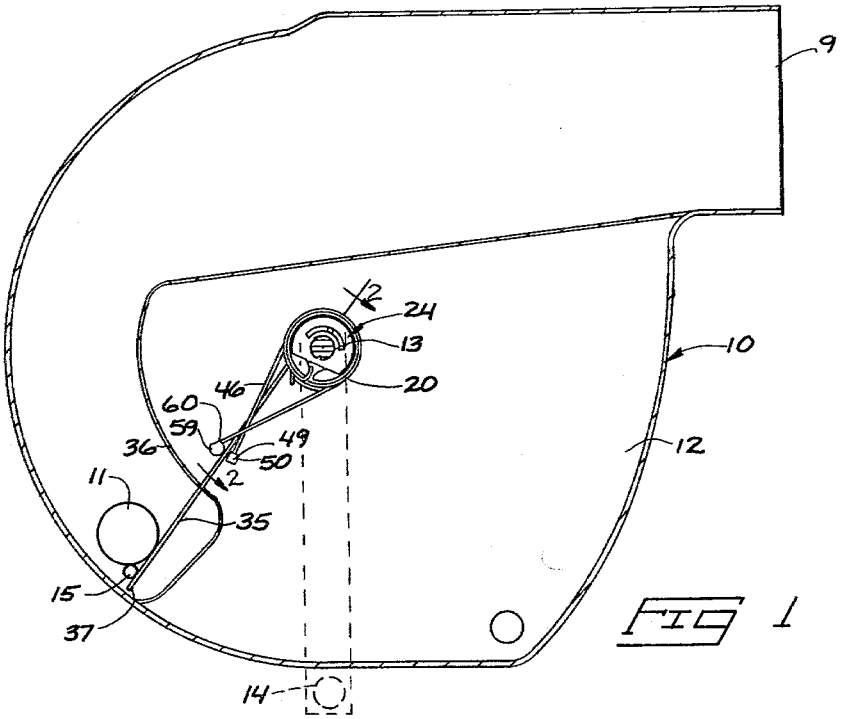
FIG. 1 is a sectional view of the present spring assembly in place within a ball throwing machine.

A ball throwing machine is generally indicated at 10 in FIG. 1 incorporating the present improved spring assembly. The machine is utilized for throwing a ball 11 along a forward trajectory. The machine includes a housing 12 having a central drive shaft 13 (not shown in FIGS. 3 and 4) that may be rotated by a crank arm 14 (illustrated in dashed lines). An abutment 15 is adjustably situated within the housing 12 at a position radially spaced from the axis of the drive shaft 13. The abutment may be selectively positioned at several radial positions to facilitate adjustment of the ball speed and trajectory as it is ejected from the housing through a tangential housing exit at 9.

Figure 2:
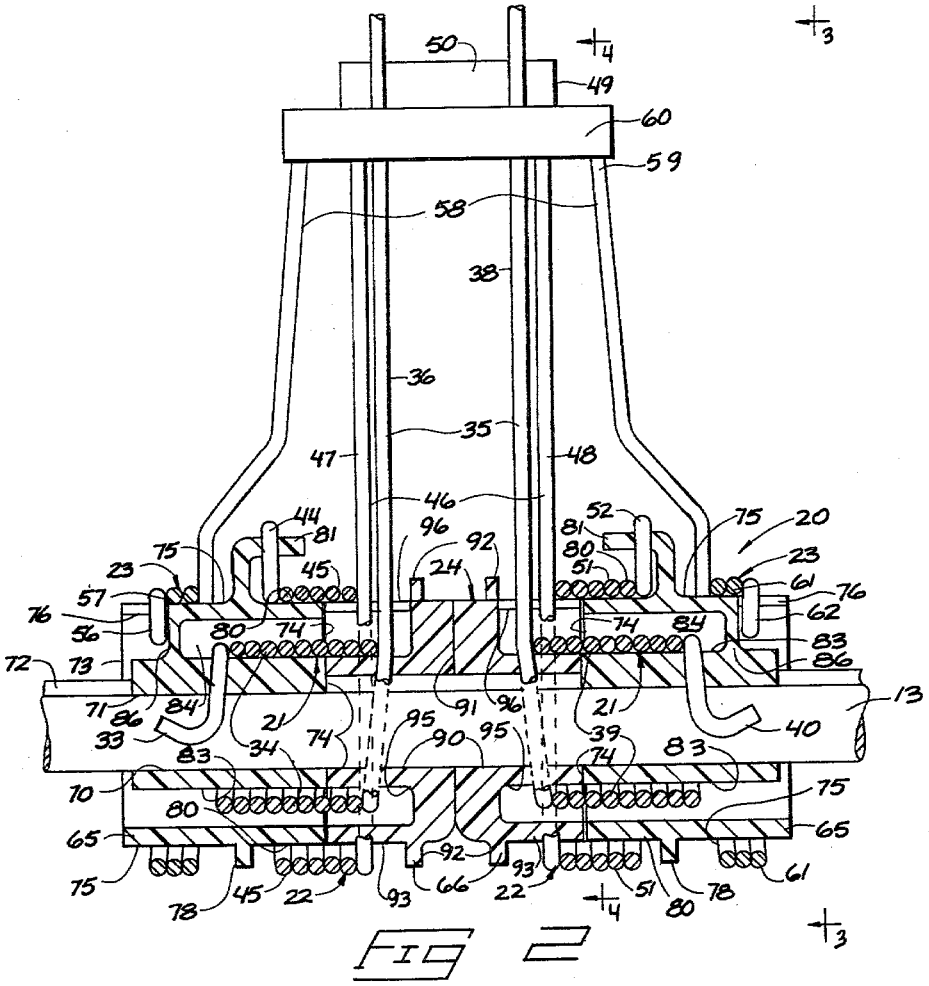
FIG. 2 is an enlarged front sectional view of the present spring assembly taken substantially along line 2—2 in FIG. 1.
Figure 3:
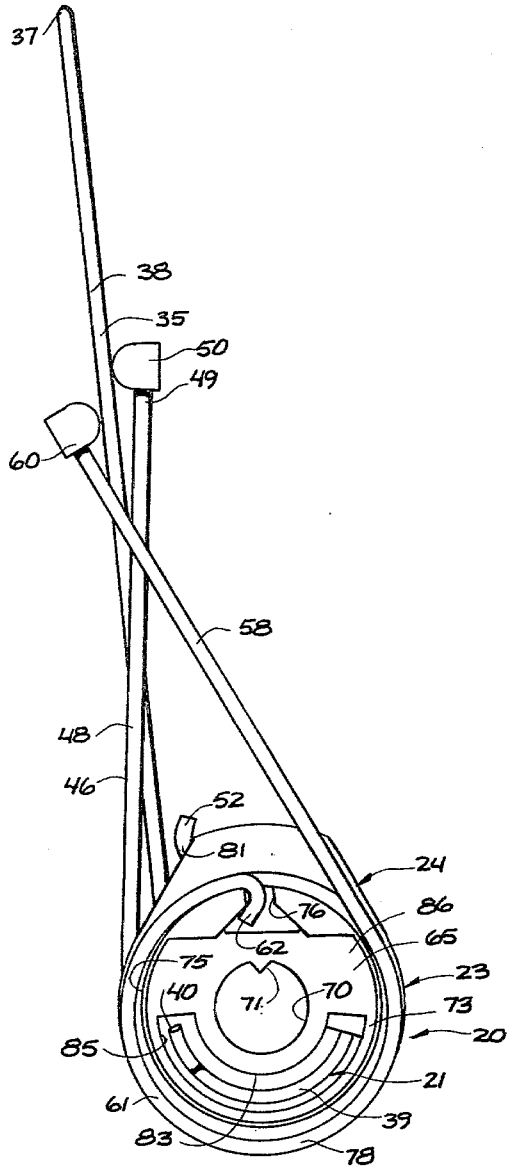
FIG. 3 is a sectioned view of the entire spring assembly from line 3—3 in FIG. 2.
Figure 4:
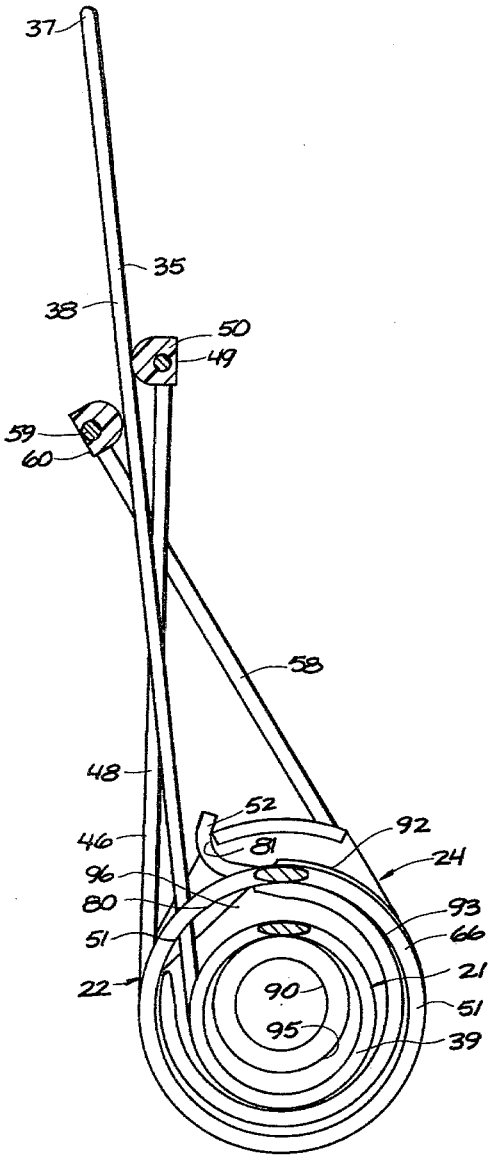
FIG. 4 is a fragmented sectional view of the assembly taken along line 4—4 in FIG. 2.
Figure 5:
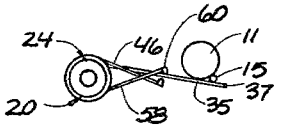
FIG. 5 is a diagrammatic view illustrating the spring assembly in a normal, unloaded configuration against an abutment of a ball throwing machine.
Figure 6:
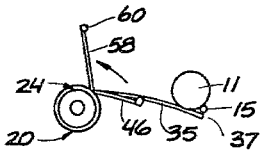
FIG. 6 illustrates the spring assembly in a loaded condition.
Figure 7:
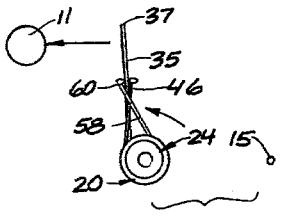
FIG. 7 diagrammatically illustrates the configuration of the spring assembly after its release from the abutment.

The present spring assembly is generally designated by the number 20 in FIG. 1. FIGS. 2 through 4 illustrate the components of the assembly 20 in more detail while FIGS. 5 through 7 illustrate its operation. Basically, the spring assembly 20 is comprised of three independent sets of springs. A primary spring means is illustrated at 21, a secondary spring means is shown at 22 and an energy absorbing means (which is also a spring) is shown at 23. All three elements are mounted to a hub means 24 and are received on the drive shaft 13.

The primary spring means and secondary spring means 21 and 22 are operatively connected at inward first ends to the drive shaft and include outwardly projecting loops. The loop 35 of the primary spring means 21 extends substantially radially outward to engage the abutment 15. Rotation of the drive shaft will bring loop 35 into engagement with the abutment (FIG. 5) while continued rotation will cause the primary and secondary spring means to load against loop 35 and abutment 15.

When a critical load has been produced within the spring, flexure along loop 35 will reduce the radial distance from the drive shaft axis to the end of the loop (FIG. 6), allowing it to slip from engagement with the abutment and forcibly rotate in the pivoted direction of travel to eject the ball from the housing (FIG. 7). The energy absorbing means 23 then functions to catch the forwardly rotating primary and secondary spring means to prevent harmful stress reversal conditions which would occur were the springs allowed to unload without restriction.

The primary spring means 21 includes a first end 33 that is hooked for engagement with the hub means 24. The first end 33 leads into a first helical portion 34 and to the outwardly extending loop 35 at an opposite end of the helical portion 34. The loop 35 includes a leg 36 extending from the first helical portion 34 to an outer end 37. A second leg 38 of the loop 35 extends back toward the axis of the first helical portion 34 to an inward end of a second helical portion 39. The second helical portion 39 leads axially to a second end 40 which is also hooked for engagement with the hub means 24.

The winding of helical portions 34 and 39 are such that the primary spring means 21 will be positively loaded as it is rotated in a first direction about the central drive shaft axis with outer end 37 engaging abutment 15.

The hub means 24 is provided to substantially align or center the helical portions on the axis of the drive shaft and hold the ends 33 and 40 for rotation with the drive shaft. Therefore, rotation of the drive shaft in a first pivotal direction (shown clockwise in FIG. 1) will cause corresponding movement of the primary spring means in a similar direction. However, when the spring loop end 37 comes into engagement with the abutment 15, the rotational movement of the loop 35 is impeded. Therefore, continued rotation of the drive shaft in the first direction will cause winding of the two helical portions 34 and 39 and corresponding loading of the loop 35 against the abutment.

The secondary spring means 22 also includes a first end 44 that is hooked and engaged with the hub means 24. The first end leads to a first helical portion 45. The opposite end of the first helical portion 45 leads to a leg 47 of an outwardly extending loop 46. The loop also includes a second leg 48 extending back from an end 49. A pad 50 is provided across the end 49 for engaging the loop 35 of the primary spring means 21. The second leg 48 leads back or inwardly toward a second helical portion 51 that is axially spaced from the first portion 45. The second helical portion 51 is coaxial with the first portion 45 and leads to an outward second end 52 that is hooked and connected to hub means 24.

The directions of the windings of the secondary spring means and primary spring means are similar to one another. The loop 46 of the second spring means engages the loop 35 of the first spring means at a point approximately one-half the distance between the axes of the helical portions and the loop end 37. The point of engagement between the loop 46 and loop 35 is on the rearward side of loop 35 with respect to its direction of movement. With this arrangement, the second spring means will load against loop 35 upon rotation of the drive shaft in the first direction while the loop end 37 remains in engagement with abutment 15.

The point of contact between the primary and secondary spring means is significant. If the primary spring were operating alone, the total "throwing" force developed through the loop 35, acting as the "throwing arm" would have to be produced within the helical windings 34 and 39. Loading along the length of the loop would be unevenly distributed between the windings and the abutment. However, when the total spring force is divided between the windings of helical portions 34 and 39 and secondary helical portions 45 and 51, the total stresses produced may be more evenly distributed along the length of the loop 35. Approximately half of the force produced at end 37 of loop 35 is exerted by the helical portions 34 and 39. The resulting bending stresses are substantially constant in the helical portions and reduce uniformly along the length of loop 35 to zero at the point of contact with abutment 15. The remaining portion of the force at abutment 15 is exerted by the secondary helical portions 45 and 51 at the loop end 49 through pad 50 on loop 35 substantially midway between the rotational axis and the outer loop end 37. Therefore, the combined bending stresses in loop 35 are substantially constant in the helical portions 34 and 39 and in loop 35 along its length from the helical portions to the point of contact of pad 50 and reduce uniformly from this point to zero bending stress the points of contact with abutment 15.

Further, as critical force for release past abutment 15 is approached end 37 of loop 35 begins to pass abutment 15 and the point of contact begins to move around the cross-sectional radius of end 37 and the radius of the abutment 15. The force between end 37 and abutment 15 is no longer tangent to the arc of motion of loop end 37 about shaft 13. The force can be separated into radial and tangential components. As loop end 37 passes abutment 15 the radial component of the force on end 37 causes further bending of the legs 36 and 38 with increased bending stresses. This can be offset by choosing a loading relation between helical portions 34 and 39 of primary spring means 21 and helical portions 45 and 51 of secondary spring means 22 such that secondary spring means 22 contributes more than half the tangential force applied to abutment 15 by loop end 37. An advantage of this configuration is that the load sharing relation between the primary spring means 21 and secondary spring means 22 can be optimized for maximum life by testing a series of known load relations to failure in fatigue.

A further advantage of above described primary and secondary spring configuration is that the spring means can be made of one piece of uniform size standard spring wire material, avoiding the mass of fasteners, with a throwing arm of reduced mass at its outer end. This maximizes the kinetic energy delivered to the ball rather than expending energy to accelerate a high mass throwing arm.

The energy absorbing means 23 is also formed as a coiled spring element. It extends from a first end 56 that is hooked and engaged with the hub means 24 to a first helical coiled portion 57. A loop 58 extends from an opposite end of the helical coiled portion, to an end 59 across loop 35 from the loop end 49 of secondary spring means 22. A pad 60 is positioned across end 59 for engagement with the loop 35 on a side opposite its engagement by a pad 50. Loop 58 extends back to an axially spaced second helical coiled portion 61 which includes a second end 62 that is also hooked and connected to the hub.

The direction of winding of the helical coiled portions 57 and 61 are opposite to that of the primary and secondary spring means 21 and 22. Movement of the loop 35 in its first direction of rotation will cause corresponding loading of the coiled portions 57 and 61 while in contact with pad 60. The pad 60 at end 59 of the loop 58 is initially in light pre-load engagement with the loop 35. The relation is such that in operation the spring means 21 and 22 are not restrained until contact with the ball ceases. The pad 60 will be forceably engaged by loop 35 only after the loop 35 has become disengaged from the abutment 15 (FIG. 7) and has moved from contact with the ball. In this manner, a higher average force is applied to the ball than would be applied if the spring force of spring means 21 and 22 reached zero at this point.

The pad will engage loop 35 very shortly after release of the ball and coiled portions 57 and 61 will load to resist further movement of the loops 35 and 46 toward the normal, "unloaded" positions shown in FIGS. 3 through 5.

The resistance begins when loop 35 contacts pad 60. As the springs pass through the preload region, the forces from the helical portions 34 and 39 of spring means 21 and helical portions 45 and 51 of spring means 21 rapidly reduce to zero. When these forces reach zero hooks 33 and 40 of spring means 21 and hooks 44 and 52 of spring means 22 begin to move away from engagement with hub means 24. As the springs move further the kinetic energy of loop 35 of spring means 21 and loop 46 of spring means 22 is transferred to spring means 23 and stored as potential energy in its helical portions 57 and 61. A portion of the energy is lost in friction between the coils and elsewhere in the system.

The relation is such that rotation of the spring with relation to hub means 24 is stopped before hooks 33 and 40 of spring means 21 and hooks 44 and 52 of spring means 22 rotate around hub means 24 sufficiently to contact the driving portions of hub means 24 in a direction of reversed loading. The system then oscillates until the remaining energy is dissipated in friction. Thus the initial motion of spring means 21 and 22 is decelerated and the energy dissipated without detrimentally loading spring means 21 and 22 in a reversed direction.

The hub means 24 is provided in four separate independent sections. Hub means 24 includes a pair of drive hubs 65 that are substantially identical but face in opposite directions. It also includes a pair of support hubs 66 that, when mounted to the three spring arrangements, are situated inwardly of the drive hubs with matching ends facing one another.

The drive hubs 65 each include a central bore 70 (FIG. 3) having a longitudinal key 71 formed along the length thereof. The key 71 is shaped to fit intimately within a key way 72 (FIG. 2) formed in the drive shaft 13. Therefore, when the drive hubs 65 are mounted to the drive shaft 13, they will rotate in unison with it.

The drive hubs 65 include outer ends 73 facing axially outward of the spring assembly 20 and inner ends 74 facing one another. Between the ends 73 and 74 of each hub 65, an annular surface 75 is provided for receiving the helical coiled portions 57 and 61 of the energy absorbing means 23. The surfaces 75 are cylindrical and are centered on the central axis of the bore 70. Slots 76 (FIG. 3) are formed through the surfaces 75 for receiving the hooked ends 56 and 62 of the coiled portions 57 and 61. They therefore interconnect the energy absorbing means and the drive shaft.

The surfaces 75 terminate at annular flanges 78 which are provided to maintain the coiled portions 57 and 61 in position on surfaces 75 and for isolating those portions 57 and 61 from the coiled portions 45 and 51 of the secondary spring means. The adjacent ends of the coiled portions 57 and 61 may slide freely over the surfaces of the flanges 78 without incurring substantial wear.

Annular surfaces 80 are provided inward of the surfaces 75. Surfaces 80 are generated about the central axes of bores 70 and, as such, are coaxial with the surfaces 75. The surfaces 80 are provided to loosely receive and support the helical coiled portions 45 and 51 of secondary spring means 22 and to provide relatively rigid connection for the hooked ends 44 and 52. To this end, abutments 81 (FIG. 4) are provided. Abutments 81 are integral with the flanges 78 and project inwardly over the surfaces 80. The hooked ends 44 and 52 may loosely engage the abutments and press against them in responce to loading of the secondary spring means. However, the hooked ends 44, 52 are free to disengage the abutments 81 upon rotational movement of the coiled portions in a direction opposite to their windings to therefore effectively reduce the opportunity for stress reversal occurring within the coils 45 and 51. The outward ends of the coiled portions 45 and 51 are spaced in close proximity to or in loose abutment with the inwardly facing surfaces of flanges 78. The inward ends of the coils extend inwardly beyond the ends 74 of the drive hubs 65.

Each drive hub 65 also includes an inner cylindrical surface 83 that is coaxial with the bore axis and is overlapped by the surfaces 75. The surfaces 83 loosely receive and mount the helical portions 34 and 39 of the primary spring means 21. They are formed by recesses 84 within the drive hubs 65 that terminate at outward transverse walls 86.

Arcuate slots 85 (FIG. 3) are provided through the walls 86. They extend arcuately about the central axis of the bores 70 to terminate at ends forming obtuse angles about the central bore axis. The hooked ends 33 and 40 of the primary spring means 21 are received within the slots 85 and abut the slot ends during loading of the helical coil portions 34 and 39. However, upon unloading, the hooked ends 33, 40 are free to move backward within the arcuate slots to prevent stress reversal within the coiled portions 34 and 39 adjacent the hooked ends. The spring is free to slide over the surfaces 83 in a direction opposite to the first pivotal direction.

The support hubs 66 are situated inwardly of and loosely contact the drive hubs 65. They include smooth cylindrical central bores 90 that are coaxial with the bores 70 when positioned on the drive shaft 13. The support hubs 66 will rotate freely on the drive shaft to act as spacing bearings between the inward ends of the coiled portions of primary and secondary spring means 21 and 22.

Each of the support hubs 66 include inner ends 91 that loosely and slidably engage one another. Transverse shoulders 92 extend radially outward from the ends 91 to provide transverse abutment surfaces for retaining the inward ends of the secondary coiled portions 45, 51 at appropriate axial positions relative to the primary spring means 21 and the energy absorbing means 23. Outward of the shoulders 92 are outer annular surfaces 93 that are cylindrical and coaxial with the axis for the central bores 90. These surfaces 93 releasably and loosely engage the coiled portions 45 and 51 of the secondary spring means 22. As the secondary spring is wound or loaded, the windings will shift eccentrically and engage the surfaces 93. Continued rotation of the spring will then cause corresponding rotation of the support hubs 66 relative to the drive shaft, both in loading and unloading. The hubs 66 rotate freely on shaft 13 in response to tangential engagement by adjacent windings.

Each of the support hubs 66 also includes a recess that is in axial alignment with the recesses 84 on the drive hubs. Each recess is defined by intercylindrical surfaces 95 spaced within the support hubs 66 directly radially inward of the outer surfaces 93. The inner surfaces 95 mount the inward ends of the helical coiled portions 34 and 39 of primary spring means 21. The windings of the coiled portions 34 and 39 move to contact the inner surfaces 95 upon loading of the primary spring means. The support hubs 66, thus engaged, will rotate freely relative to the drive shaft, acting as a bearing between the helical windings and the shaft.

Notches 96 are provided through the surface 93 through which the legs of the loops 35 and 46 extend. The notches are relatively large to allow free movement of the loops relative to the surfaces 93 and 95.

The illustrated construction of the hub means as four separate members facilitates assembly and disasssembly of the entire unit. The drive hubs and support hubs can be selectively removed from engagement with the three spring assemblies to allow separation of the individual springs, facilitating substitution or replacement.

The function of the present spring assembly 20 is illustrated diagrammatically in FIGS. 5 and 7. In FIG. 5, the end 37 of loop 35 has been moved by the drive shaft 13 into engagement with the abutment 15. At this point there is no increase in loading of the primary and secondary springs beyond the slight preload condition caused by the energy absorbing means. Additional loading occurs as the drive shaft 13 continues to rotate in the first rotational direction (indicated by arrows in FIGS. 6–7). Resistance of the abutment to rotation causes loading in the windings of the primary and secondary spring means and produces corresponding loading along the length of the loop 35. A portion of the force produced at end 37 is produced within the primary windings of helical portions 34 and 39, while the remaining force is applied by the secondary windings at the loop end 49 against loop 35, substantially halfway between its helical windings and its outer end 37. The combined stresses along the loop 35 are therefore substantially constant from the windings to pad 50 and reduce uniformly along the shortened cantilever from pad 50 to abutment 15.

It may be noted in FIG. 6 that during loading of the spring means 21 and 22, the energy absorbing means 23 is moved from engagement with the loop 35, after the slight pre-loading has been released. In fact, the loop 58 of means 23 will pivot along with corresponding pivotal movement of the drive shaft. This allows free pivotal movement of the loops 35 and 46 during unloading of the primary and secondary spring means after disengagement of the loop end 37 and abutment 15. The full amount of stored energy that is intended to be delivered to the ball 11 is therefore transmitted without interference by the engergy absorbing means. It is only after the ball 11 flies free from contact with the still accelerating loop end 37 that the loop 35 comes into forceable contact again with pad 60 (FIG. 7). The energy absorbing means 23 at that point functions to absorb the remaining stored energy and kinetic energy of the primary and secondary springs and successfully avoids detrimental stress reversal in the primary and secondary windings.

It is understood that the drawings and above description are given by way of example to set forth a preferred form of the present invention. The scope of the invention is set forth by the following claims:

What we claim is:

1. A spring assembly for a ball throwing machine having a central drive shaft rotatable on a central axis and a throwing arm abutment, the spring assembly comprising:

primary coil spring means adapted to encircle the central drive shaft, said primary coil spring means having one end adapted to be operably connected to the central drive shaft and a remaining end in the form of a throwing arm having first and second opposed surfaces, the first of said opposed surfaces of the throwing arm being adapted to releasably engage the throwing arm abutment;

secondary coil spring means adapted to encircle the central drive shaft, said secondary coil spring means having one end adapted to be operably connected to the central drive shaft and a remaining end extending outward therefrom for engaging the second of said opposed surfaces of the throwing arm;

the secondary coil spring means being adapted to load and unload in unison with the primary coil spring means; and energy absorbing means adapted to encircle the central drive shaft, said energy absorbing means having one end adapted to be operable connected to the central drive shaft and a remaining end extending outward therefrom for engaging the first of said opposed surfaces of the throwing arm for limiting stress reversal in the primary and secondary coil spring means by loading against the throwing arm in response to unloading of the primary and secondary coil spring means.

2. The spring assembly as defined by claim 1 further comprising:

a drive hub member and an independent support hub member;

means on the drive hub member for mounting it to the shaft in fixed angular relationship thereon for rotation in unison with the shaft;

means on the support hub member for mounting it on the shaft for free rotation about the central axis;

the one end of the primary coil spring means and the one end of the secondary coil spring means being releasably mounted to the drive hub; and the primary and secondary coil spring means including helical coiled portions loosely encircling the support hub member.

3. The spring assembly as defined by claim 1 further comprising:

drive hub means interconnected to the one end of each of said primary and secondary coil spring means, said drive hub means being adapted to be fixed to the drive shaft;

the drive hub means further including annular surfaces thereon for receiving and coaxially mounting the primary and secondary coil spring means.

4. The spring assembly as defined by claim 3 wherein the energy absorbing means is comprised of a helical coiled spring loosely encircling the drive hub means and having said one end thereof anchored to the drive hub means.

5. The spring assembly as defined by claim 4 wherein the primary coil spring means, secondary coil spring means and energy absorbing means each includes a helical coil mounted coaxially on the drive hub means with the helical coil of the primary coil spring means being located radially inward of the helical coils of the secondary coil spring means and energy absorbing means.

6. The spring assembly as defined by claim 1 wherein the primary coil spring means comprises:

a first helical coiled portion having a first end adapted to be connected to the drive shaft;

said throwing arm being a loop formed at an axial end of the first helical coiled portion and extending outward therefrom; said loop having two adjacent legs, one leg thereof being connected to the first helical coiled portion;

a second helical coiled portion having a first end connected to the remaining leg of the loop, said second helical coiled portion being arranged coaxially with the first helical coiled portion and having a second end adapted to be connected to the drive shaft.

7. The spring assembly as defined by claim 6 wherein the secondary coil spring means comprises:

a first helical coiled portion having a first end adapted to be connected to the drive shaft;

a loop formed at an axial end of the first helical coiled portion and extending outward therefrom, said loop having two adjacent legs, one leg thereof being connected to the first helical coiled portion;

a second helical coiled portion having a first end connected to the remaining leg of the loop, said second helical coiled portion being arranged coaxially with the first helical coiled portion and having a second end adapted to be connected to the drive shaft.

8. The spring assembly as defined by claim 1 wherein the secondary coil spring means comprises:

a first helical coiled portion having a first end adapted to be connected to the drive shaft;

a loop formed at an axial end of the first helical coiled portion and extending outward therefrom, said loop having two adjacent legs, one leg thereof being connected to the first helical coiled portion;

a second helical coiled portion having a first end connected to the remaining leg of the loop, said second helical coiled portion being arranged coaxially with the first helical coiled portion and having a second end adapted to be connected to the drive shaft;

wherein the loop of the secondary coil spring means extends to an outer end releasably engaging the second of said opposed surfaces of the throwing arm at a point approximately half way along its length.

9. The spring assembly as defined by claim 8 wherein the energy absorbing means comprises:

a first helical coiled portion having a first end adapted to be connected to the drive shaft;

a loop formed at an axial end of the first helical coiled portion and extending to an outer end releasably engaging the first of said opposed surfaces of the throwing arm; and a second helical coiled portion connected to the loop, said second helical coiled portion being arranged coaxially with the first helical coil portion and having a second end adapted to be connected to the drive shaft.

10. The spring assembly as defined by claim 1 wherein the energy absorbing means comprises:

a first helical coiled portion having an end adapted to be connected to the drive shaft;

a loop formed at an axial end of the first helical coiled portion and extending to an outer end releasably engaging the first of said opposed surfaces of the throwing arm; and a second helical coiled portion connected to the loop, said second helical coiled portion being arranged coaxially with the first helical coil portion and having a second end adapted to be connected to the drive shaft.

11. The spring assembly as defined by claim 10 wherein the primary coil spring means comprises:

a first helical coiled portion having a first end adapted to be connected to the drive shaft;

said throwing arm comprising a loop formed at an axial end of the first helical coiled portion and extending outward therefrom; said loop having two adjacent legs, one leg thereof being connected to the first helical coiled portion;

a second helical coiled portion having a first end connected to the remaining leg of the loop, said second helical coiled portion being arranged coaxially with the first helical coiled portion and having a second end adapted to be connected to the drive shaft.

12. The spring assembly as defined by claim 11 wherein the secondary coil spring means comprises:

a first helical coiled portion having a first end adapted to be connected to the drive shaft;

a loop formed at an axial end of the first helical coiled portion and extending outward therefrom, said loop having two adjacent legs thereof being connected to the first helical coiled portion;

a second helical coiled portion having a first end connected to the remaining leg of the loop, said second helical coiled portion being arranged coaxially with the first helical coiled portion and having a second end adapted to be connected to the drive shaft.

13. The spring assembly as defined by claim 12 further comprising:

a pair of drive hub members adapted for mounting to the shaft in fixed angular relation and axially spaced thereon for rotation in unison with the shaft;

the first and second helical coiled portions of the primary coil spring means being loosely received by the drive hub members;

arcuate slots formed within the drive hub members for receiving the first and second ends of the respective first and second helical coiled portions of the primary coil spring means;

the first and second helical coiled portions of the secondary coil spring means being loosely received by the drive hub members radially disposed from the helical coiled portions of the primary coil spring means; and abutments on the drive hub means for releasably engaging the first and second ends of the respective first and second helical coiled portions of the secondary coil spring means.

14. The spring assembly as defined by claim 13 further comprising:

a pair of support hubs adapted to be mounted to the shaft for free rotation thereon about the shaft axis, loosely contacting and axially spacing the pair of drive hub members.

* * * * *